US009825371B2

(12) United States Patent
Mayeux

(10) Patent No.: US 9,825,371 B2
(45) Date of Patent: Nov. 21, 2017

(54) SEGMENTED STRUCTURE, PARTICULARLY FOR SATELLITE ANTENNA REFLECTOR, PROVIDED WITH AT LEAST ONE STRIP-COMPRISING UNFURLING DEVICE

(71) Applicant: Airbus Defence and Space SAS, Les Mureaux (FR)

(72) Inventor: Christophe Mayeux, Mareil Marly (FR)

(73) Assignee: Airbus Defence and Space SAS, Les Mureaux (FR)

( * ) Notice: Subject to any disclaimer, the term of this patent is extended or adjusted under 35 U.S.C. 154(b) by 0 days.

(21) Appl. No.: 15/102,489

(22) PCT Filed: Dec. 10, 2014

(86) PCT No.: PCT/FR2014/000267

§ 371 (c)(1),
(2) Date: Jun. 7, 2016

(87) PCT Pub. No.: WO2015/092160

PCT Pub. Date: Jun. 25, 2015

(65) Prior Publication Data

US 2016/0315393 A1 Oct. 27, 2016

(30) Foreign Application Priority Data

Dec. 17, 2013 (FR) ..... 13 02971

(51) Int. Cl.
*H01Q 19/10* (2006.01)
*H01Q 15/16* (2006.01)
(Continued)

(52) U.S. Cl.
CPC ..... *H01Q 15/162* (2013.01); *H01Q 1/288* (2013.01); *H01Q 15/16* (2013.01); *H01Q 15/20* (2013.01)

(58) Field of Classification Search
CPC ..... H01Q 21/28; H01Q 1/243
(Continued)

(56) References Cited

U.S. PATENT DOCUMENTS 4,811,034 A 3/1989 Kaminskas

FOREIGN PATENT DOCUMENTS

EP 1 043 802 A2 10/2000
FR 2 777 118 A1 10/1999
(Continued)

OTHER PUBLICATIONS

International Search Report dated Mar. 30, 2015, issued in corresponding International Application No. PCT/FR2014/000267, filed Dec. 10, 2014, 8 pages.
(Continued)

*Primary Examiner* — Graham Smith
(74) *Attorney, Agent, or Firm* — Christensen O'Connor Johnson; Matthew Balint; John Denkenberger

(57) ABSTRACT

A segmented structure comprising at least two panels, one panel referred to as a main panel and at least one panel referred to as a secondary panel, together with at least one unfurling device able to bring a secondary panel into a storage position or into an unfurled position, the unfurling device comprising at least one strip fixed to the secondary panel and connected to the main panel, the strip being elastically preloaded into the storage position thereof so as to unfurl automatically and autonomously when relative movement between the secondary panel and the main panel becomes possible, so as to move the secondary panel.

15 Claims, 4 Drawing Sheets

(51) Int. Cl.
*H01Q 1/28* (2006.01)
*H01Q 15/20* (2006.01)

(58) Field of Classification Search
USPC ..... 343/834
See application file for complete search history.

(56) References Cited

FOREIGN PATENT DOCUMENTS

| | | | |
|---|---|---|---|
| JP | S58 101507 | A | 6/1983 |
| WO | 2009/153454 | A2 | 12/2009 |

OTHER PUBLICATIONS

Written Opinion dated Mar. 30, 2015, issued in corresponding International Application No. PCT/FR2014/000267, filed Dec. 10, 2014, 6 pages.
International Preliminary Report on Patentability dated Jun. 21, 2016, issued in corresponding International Application No. PCT/FR2014/000267, filed Dec. 10, 2014, 1 page.
Written Opinion of the International Searching Authority dated Mar. 30, 2015, issued in corresponding International Application No. PCT/FR2014/000267, filed Dec. 10, 2014, 8 pages.

SEGMENTED STRUCTURE, PARTICULARLY FOR SATELLITE ANTENNA REFLECTOR, PROVIDED WITH AT LEAST ONE STRIP-COMPRISING UNFURLING DEVICE

The present invention relates to a segmented structure.

This segmented structure comprises at least two panels connected together and intended for deployment in space.

Although not exclusively, the present invention applies more particularly to a segmented structure forming part of a telecommunication satellite antenna reflector, in particular to a large antenna reflector, functioning in high frequency bands. The size of the reflector is inversely proportional to the frequency (at constant gain). Such an antenna reflector generally comprises a rigid structure (referred to as the shell) provided with a reflective surface and reinforcement means at the rear of this surface, which participate in the holding of the shell and in the connection to the satellite.

The large size of the shell of such a reflector poses problems of space requirement when a satellite provided with such a reflector is sent into space by means of a space launcher.

Thus, for rigid reflectors having diameters of several meters, a segmented structure is provided, provided with a plurality of panels, in particular a structure with three panels comprising a middle panel and two end panels.

This segmented structure also comprises a deployment device for each end panel, which is able to bring the end panel, relative to the main panel:

- either into a storage position, in which the end panel is superimposed on the main panel on the rear face of thereof, the front face of the end panel being directed in the same direction as the front face of the main panel;
- or in a deployed position, in which the end panel is positioned alongside and against the main panel so as to form a continuous assembly at least on the front faces thereof (active part of an antenna).

In such a segmented structure, each end panel can therefore adopt a storage position for transport in the space launcher and a deployed position when the satellite is in space.

Through the document EP-1 043 802, a segmented structure is known, comprising various panel-deployment means. In a particular embodiment, the deployment means comprise, in addition to a pivoting arm, a cable. This cable is a single cable that solely implements a step of the deployment phase.

The present invention relates to a segmented structure, in particular for a satellite antenna reflector, comprising at least two panels and a deployment device making it possible to carry out in space effective and advantageous deployment of these two panels.

According to the invention, said segmented structure of the type comprising:

- at least two panels, a first so-called main panel comprising a front face and a rear face, and a second so-called secondary panel also comprising a front face and a rear face; and
- at least one deployment device connected to the rear faces respectively of said main and secondary panels and suitable for bringing said secondary panel into one or other of the following two positions, relative to said main panel:
  - a storage position, in which said secondary panel is at least partly superimposed on said main panel on the rear face of thereof, the front face of said secondary panel being directed in the same direction as the front face of said main panel; and
  - a deployed position, in which said secondary panel is positioned towards the outside of the main panel, alongside and against said main panel so as to form a continuous assembly at least on the front faces thereof, is remarkable in that said deployment device comprises:

- at least one strip, said strip being fixed by a first of the ends thereof to the secondary panel at a so-called contact face thereof, which comes into contact with a so-called contact face of the main panel in the deployed position, and being connected to the main panel at the contact face thereof, said strip:
  - having a flexibility allowing it to be folded at least at so-called hinge regions in the storage position;
  - being resiliently prestressed in the storage position so as to unwind automatically and autonomously, when the movement between the secondary panel and the main panel is released, so as to move the secondary panel during the unwinding until it reaches a substantially rectilinear unwound position;
  - self-locking in the unwound position; and
- at least one reel device that is suitable for reeling up said strip from its unwound position, a reeling of the strip bringing the secondary panel towards the main panel.

Thus, by virtue of the invention, the secondary panel of the segmented structure may be deployed effectively and advantageously in space, from the storage position to the deployed position, as specified below.

Moreover, in a preferred embodiment, said segmented structure comprises removable means for holding the secondary panel on the main panel, said holding means being controllable and making it possible to release the secondary panel from the main panel when they are controlled, such a release releasing the movement between said secondary panel and said main panel.

Advantageously, said strip, of the technically "tape-measure" type, has at least one of the following features:

- it is provided with flexible thermal shields at least at said hinge regions;
- it is provided, at least partly, with a surface treatment;
- it is made of one of the following materials: a metal material or a composite material.

It should be noted that the document EP-1 043 802 does not disclose the use of a particular strip that makes it possible to implement main deployment steps, namely a "tape measure" that has simultaneously all the aforementioned characteristics.

Moreover, advantageously:

- the segmented structure comprises removable auxiliary holding means suitable for holding the strip, in the storage position; and/or
- the segmented structure comprises means suitable for generating thrust on the secondary panel in order to move it away from the main panel so as to assist deployment; and/or
- the reel device is provided with an electric motor arranged in the structure of the main panel; and/or
- the segmented structure comprises a damping device suitable for damping any shocks liable to be generated at least at the time of the self-locking of said strip; and/or
- the segmented structure comprises means configured so as to provide end guidance making it possible to achieve the deployed position.

Moreover, in a particular embodiment, each deployment device is configured so as to achieve the simultaneous deployment of the secondary panel and of at least one intermediate panel that are such that said intermediate panel is arranged between the secondary panel and the main panel, superimposed in the storage position and in lateral contact in the deployed position, and the intermediate panel is connected to the strip so as to be able to slide along said strip. Preferably, said strip passes at least partly through the structure of said intermediate panel. In a particular embodiment, the segmented structure comprises a plurality of intermediate panels between the main panel and a secondary panel.

Moreover, in a preferred embodiment, the segmented structure comprises:

- a middle main panel;
- two secondary panels arranged on either side of said middle main panel in the deployed position so as to have a parabolic shape; and
- two deployment devices associated respectively with said secondary panels.

The present invention also relates to:

- a satellite antenna reflector that comprises a segmented structure as aforementioned, and
- a satellite that comprises at least one such segmented structure or one such antenna reflector.

The present invention also relates to a method for deploying a segmented structure as aforementioned.

According to the invention, this method comprises successive steps consisting, during deployment from the storage position to the deployed position, of:

a) releasing the movement of the secondary panel with respect to the main panel, this release allowing automatic unwinding of the prestressed strip so as to bring the secondary panel from a superimposed position to a position substantially in the same mid-plane as the main panel, said strip self-locking when it is completely unwound; and b) reeling up the strip, by means of the reel device, so as to bring the secondary panel towards the main panel until the respective contact faces thereof are substantially in contact, in particular so that end guidance can be implemented.

Advantageously, the pivoting method comprises a supplementary step consisting of effecting end guidance for achieving the deployed position.

The figures of the accompanying drawings will give a clear understanding as to how the invention can be implemented. In these figures, identical references designate similar elements.

Figure 1:
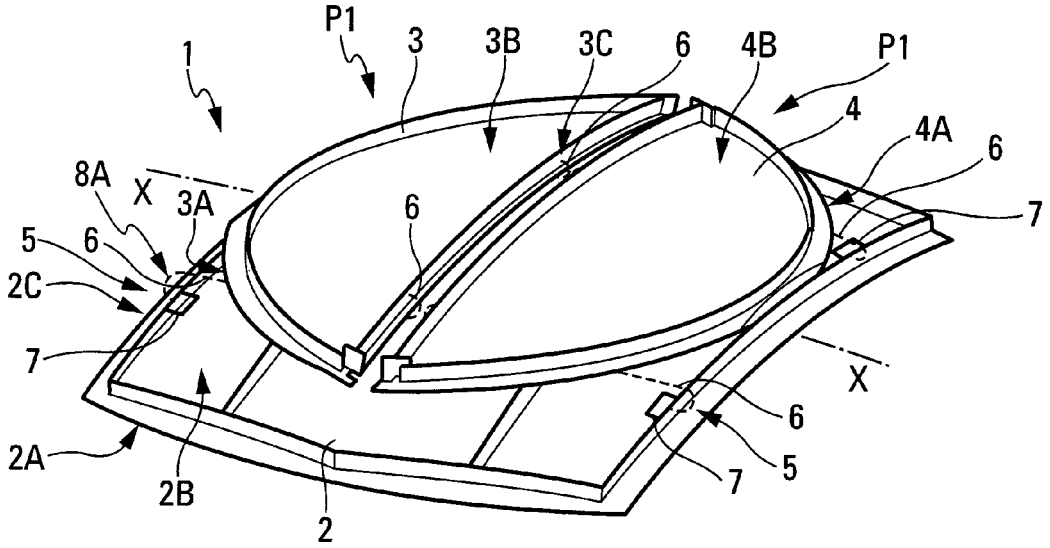
FIG. 1 is a schematic perspective view of a particular embodiment of a segmented structure illustrating the invention and comprising a middle main panel, as well as two secondary panels, each of which is in a storage position.

The segmented structure 1, illustrating the invention and depicted schematically in FIG. 1 in particular, is intended, more particularly but not exclusively, for a telecommunication satellite antenna reflector. Such an antenna reflector generally comprises, when it is deployed in space, a rigid structure (referred to as the shell) provided with a reflective surface, as well as reinforcing and holding means (not shown) at the rear of this structure, which participate in the holding of the shell and in the connection to the satellite. In particular for reasons of space requirement when the satellite is launched by a space launcher, this structure is of the segmented type, that is to say it is formed by a plurality of segments or panels.

More precisely, the present invention relates to a segmented structure 1 of the type comprising:

- at least two panels, namely at least a first so-called main panel 2 comprising a front face 2A and a rear face 2B, and at least a second so-called secondary panel 3, 4 also comprising a front face 3A, 4A and a rear face 3B, 4B: and
- at least one deployment device 5 that is connected respectively to the main panel 2 and to an associated secondary panel 3, 4.

Figure 5A:
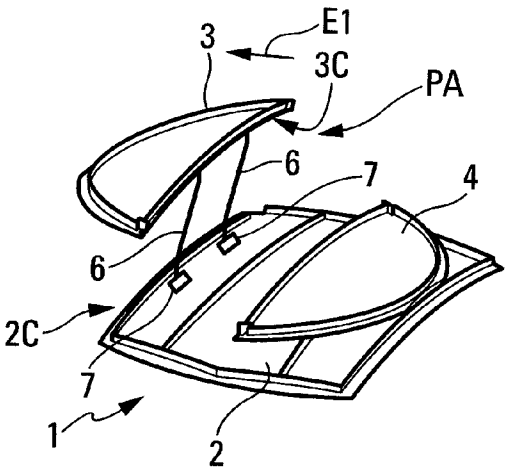
FIG. 5A to 5F illustrate, in a schematic view in perspective, various successive steps of deployment of a secondary panel with respect to a main panel of a segmented structure.
Figure 5B:
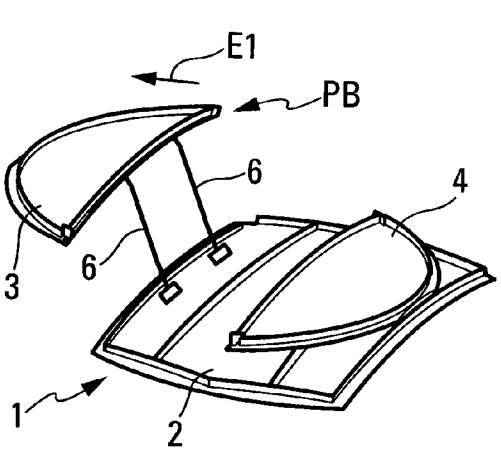
Figure 5C:
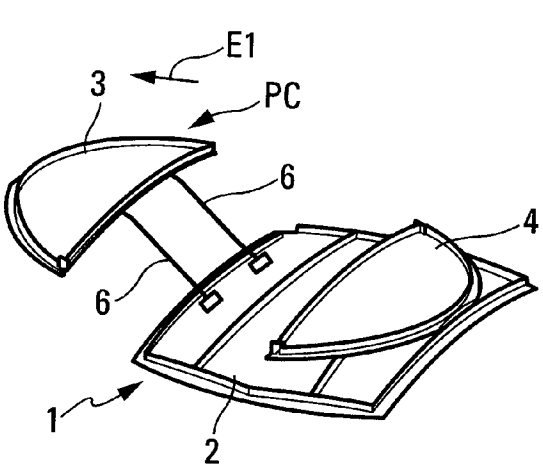
Figure 5D:
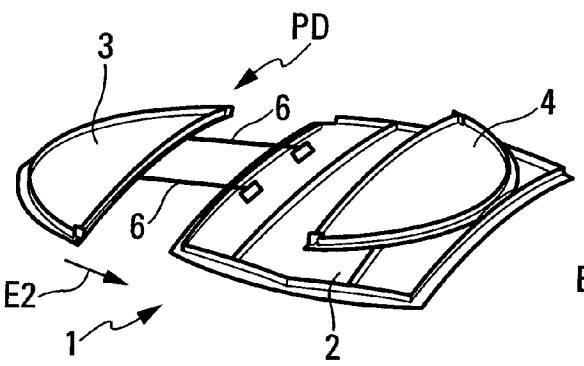
Figure 5E:
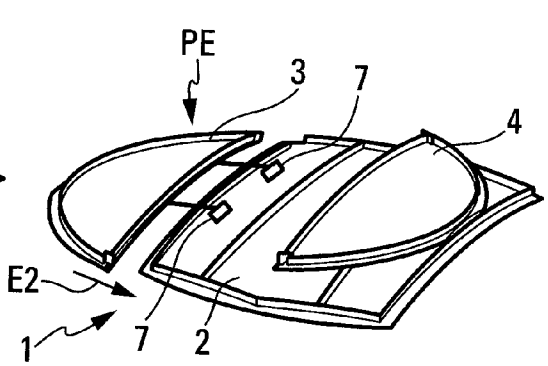
Figure 5F:
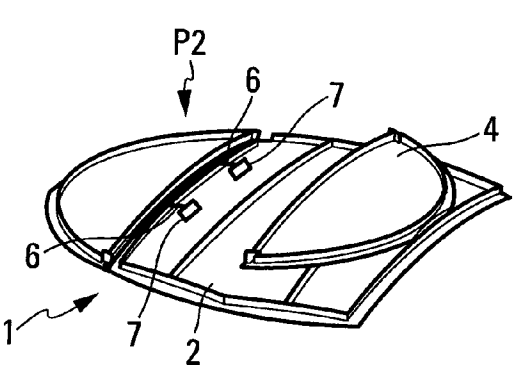

This deployment device 5 is suitable for bringing the corresponding secondary panel, for example the secondary panel 3, into one or other of the following two positions, relative to the main panel 2:

- a storage position P1, as depicted in FIG. 1, in which said secondary panel 3 is at least partly superimposed and preferably completely superimposed on the main panel 2 on the rear face 2B thereof. The front face 3A of the secondary panel 3 is directed in the same direction as the front face 2A of the main panel 2: and
- a deployed position P2, as depicted in FIGS. 2 and 5F, in which the secondary panel 3 is positioned alongside and against the main panel 2 so as to form a continuous assembly at least on the front faces thereof 2A and 3A.

In the description of the present invention:

- front face and rear face mean the two faces of a panel, the front face 3A, 4A of a secondary panel 3, 4 being at least partly superimposed on the rear face 2B of the main panel 2. Preferably, as shown in particular in the examples in FIGS. 1, 2, 5A to 5F and 7, each front face 2A, 3A, 4A corresponds in the case of an antenna reflector to the reflective face. It is however also possible for this to be the opposite, as in the example in FIG. 10 described below; and
- internal, inside, inward, etc. and external, outside, outward, etc. mean the positions of the various elements concerned with respect to the centre of the segmented structure 1 in the deployed position thereof (FIG. 2), "internal, inside, inward, etc." applying to the position closest to the centre and "external, outside, outward, etc." applying to the position furthest away from the centre in this deployed position (in the direction of an axis X-X (FIG. 1), in this case an axis of symmetry of the segmented structure 1).

Figure 2:
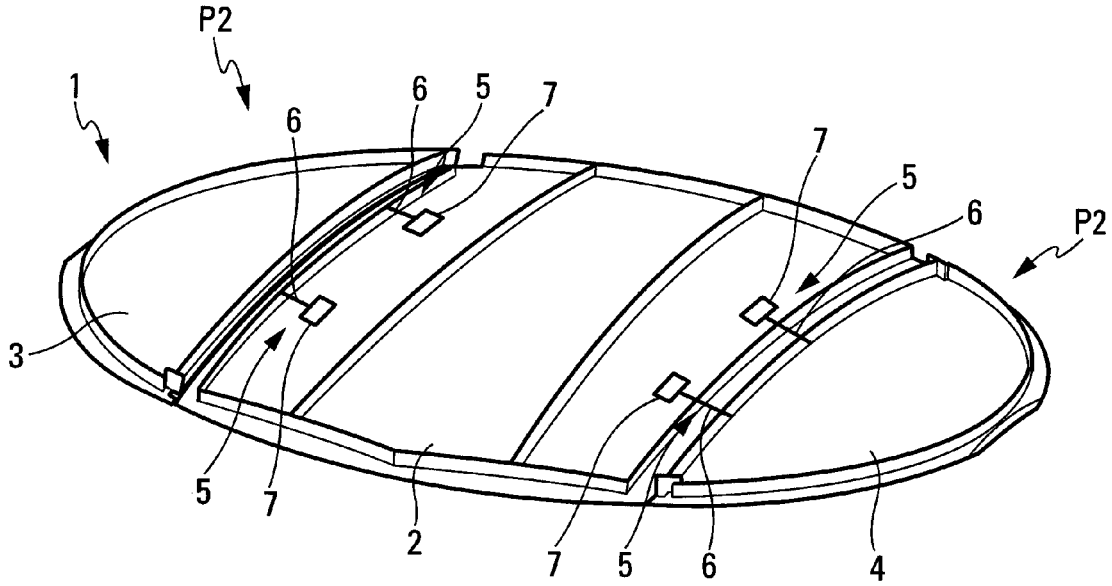
FIG. 2 is a schematic perspective view of a particular embodiment of a segmented structure illustrating the invention and comprising a middle panel as well as two secondary panels, each of which is in a deployed position.

In the preferred embodiment, depicted in FIGS. 1 and 2, the segmented structure 1 comprises:

a middle main panel 2;

two secondary panels 3 and 4 arranged on either side of said middle main panel 2 in the fully deployed position (FIG. 2) so that these three panels 2, 3 and 4 have a parabolic form in this fully deployed position; and two deployment devices 5 associated respectively with said secondary panels 3 and 4.

According to the invention, each of the deployment devices 5 of the segmented structure 1 comprises:

at least one strip 6, and preferably two strips 6 (or more than two strips 6) depicted highly schematically by dashes in FIG. 1; and at least one reel device 7, namely as many reel devices 7 as there are strips 6. Each reel device 7 is associated with a strip 6 and is suitable for reeling up the strip 6 with which it is associated from an unwound position (FIG. 5D) as specified below. A reeling up of the strip 6 has the effect of pulling the secondary panel 3, towards the main panel 2, from outside to inside, until respective contact faces 2C and 3C (FIG. 5A) are substantially in contact (FIG. 5F).

To do this, according to the invention, each strip 6 is fixed by a first of the ends thereof to the secondary panel 3, at a so-called contact face 3C thereof (which comes into contact with a so-called contact face 2C of the main panel 20 in the deployed position P2). In addition, the strip 6 is connected to the main panel 2 at the contact face 20 thereof.

Furthermore, according to the invention, each strip 6:

performs an action that may be symmetrical;

has flexibility allowing it to be folded at least at so-call hinge zones 8A, 8B (FIGS. 1 and 3) in the storage position P1;

is resiliently prestressed in the storage position P1 so as to unwind automatically and autonomously, when the movement between the secondary panel 3, 4 and the main panel 2 (which is blocked in the storage position P1) is released, in order to move the secondary panel 3, 4 during unwinding, until it reaches an unwound position PD in which the strip 6 has longitudinally a substantially rectilinear form (FIG. 5D); and self-locks in the unwound position PD, that is say is provided with some rigidity in this unwound position, making it possible to hold the secondary panel 3, 4 with respect to the main panel 2 substantially in one plane, and to pull the secondary panel 3, 4 towards the main panel 2 while maintaining this relative position.

Figure 3:
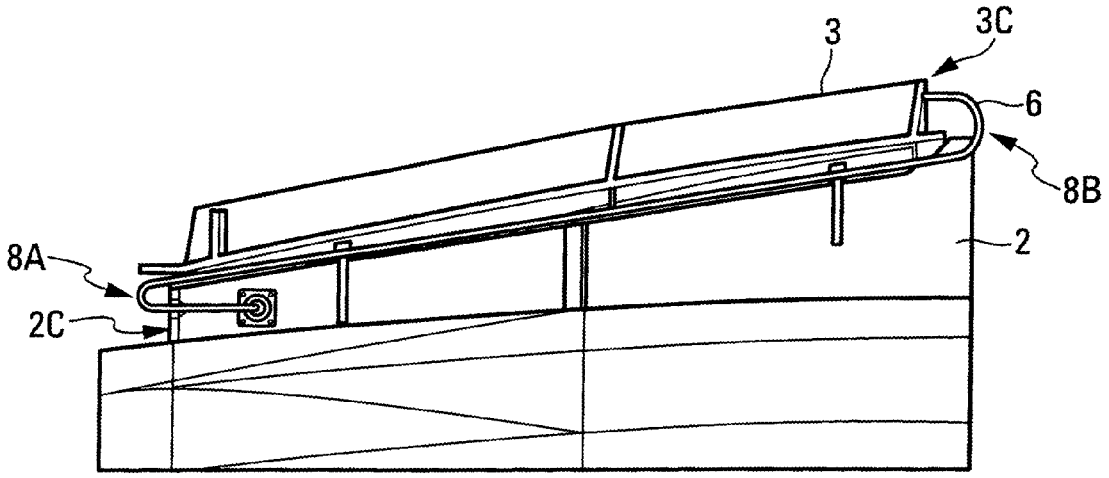
FIG. 3 illustrates schematically the arrangement of a strip.

The segmented structure 1 therefore comprises one or more reel devices 7, in the vicinity of the contact edge 2C between the middle main panel 2 and the movable secondary panel 3, 4 when it is deployed. In the storage position P1 (FIG. 1), the deployable secondary panels 3 and 4 are placed above the main panel 2 so as to limit the space requirement of the structure to the maximum, the strip 6 then adopting a generally "Z" shape, as depicted in FIG. 3. Although shown schematically in FIG. 2, the strips 6 and the reel devices 7 (which are arranged inside the structure) are of course not visible in the perspective view, in the deployed position P2.

The embodiment depicted in particular in FIG. 5A to 5F comprises two strips 6 with two reel devices 7. The number of strips 6 can be adapted according to the characteristics of the segmented structure 1 and the deployment constraints.

The segmented structure 1 moreover comprises means (not shown) for holding the secondary panel 3, 4 on the main panel 2 that are distributed around each deployable secondary panel and are of the separable (or removable) type. These holding means are controllable and make it possible to release the secondary panel 3, 4 from the main panel 2 when they are controlled (via a normal deployment instruction), such release allowing the movement between the corresponding secondary panel 3, 4 and the main panel 2 and allowing the strip or strips 6 to come into action.

Such a deployment device 5 makes it possible to achieve effective and advantageous deployment of the secondary panel 3, 4, with which it is associated, from the storage position P1 (FIG. 1) to the deployed position P2 (FIG. 2), as stated below.

Figure 4A:
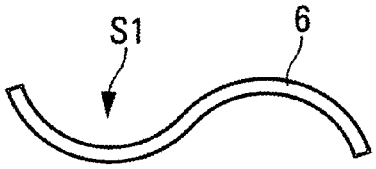
FIGS. 4A and 4B illustrate various examples of a cross section of a strip.
Figure 4B:
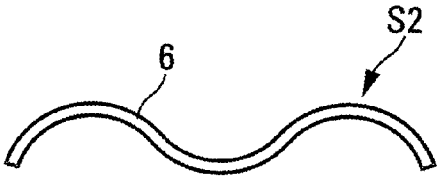

The order of magnitude of the thickness of the strip 6 is a few tenths of a millimeter, so as to have the necessary flexibility for holding in the wound position (in the "Z" shape). The strip 6 has, in cross section, a curved shape that is such that, when the strip 6 unwinds, itself-lochs in the straight position (a "ratchet" phenomenon or effect) like a "tape measure". The form of the strip 6 is such that, for this "ratchet" effect to occur, the strip 6 is folded in one direction or in the other (symmetrical shape and action). In a particular embodiment, the strip 6 has, as a symmetrically shaped cross section:

across section S1 in the form of a tilde "~", as depicted in FIG. 4A; or a cross section S2 in the form of a "w" with rounded angles, as depicted in FIG. 4B.

The strip 6 is provided with special regions (hinge regions 8A, 8B) having significantly lower bending stiffness, for example over a few centimeters, in order to localise folding regions of the strip 6 (virtual pivot connection), so that the deployment kinematics are reproducible and predictable. This effect can be obtained by a local narrowing of the curved shape and/or by a minor modification to the thickness of the strip 6. In particular, the deployment and rewinding can thus be achieved many times on the ground, using a gravity compensation system.

The stiffness of the strip 6 is determined so that the deployment kinematics are suited to the inertias of the secondary panels 3 and 4, and cause a minimum of parasitic vibratory movements.

For the strip 6 (spring), a high modulus of resilience, satisfactory strength and good resistance to alternating bending are sought. It is possible for example to use a 45Si7 steel alloy (leaf spring) or a "piano wire" type spring. It is also possible to use Elinvar (steel with 33% nickel, 12% chromium, 1.2% manganese) in order to obtain a Young's modulus independent of the temperature.

Moreover, in a particular embodiment, in which the strip 6 also serves to transmit a signal (in electrical form) or electrical power, it is possible to use a cuproberyllium (Cu—Be) alloy. Its resilient limit is as high as a 1000 MPa, with very good resistance, and very good thermal and electrical conductivity.

It is also possible to use composite materials, in particular based on glass fibres or carbon fibres, which have advantageous strength and mass characteristics.

In addition to the choice of material, the performance of the strip 6 is also dependent on a surface treatment applied to said strip 6. This treatment may for example be prestressing blasting on a metal material.

In the folded position, the deployable secondary panels 3 and 4 are stacked by points distributed at the periphery of the main panel 2. Release of the stacking points allows automatic deployment of the secondary panels 3 and 4 through the spring effect of the strips 6.

In a particular embodiment, the segmented structure 1 comprises auxiliary means (not shown) suitable for generating thrust on the secondary panel 3, 4 in order to move it away from the main panel 2, so as to assist the deployment thereof. Preferably, to do this, springs are incorporated in the panel stacking device, in order to generate a pulse (thrust) at the start of the deployment of the deployable secondary panels 3 and 4.

Moreover, in order to limit the influence of the temperature on the stiffness of the strip or strips 6, each strip 6 is provided with flexible thermal shields at least at said flexible hinge regions 8A, 8B.

Moreover, in a particular embodiment, the strips 6, the natural frequency of which is very low (very slender flexible structure), are secured to the structure of the middle main panel 2 by means of aramid fibres or other similar systems. These fibres are cut at the same time as the stacking points (or just a short time before) by a hot wire at the moment of deployment.

The present invention has numerous advantages, and in particular:

- the space between the middle main panel 2 and the secondary panels 3 and 4 is very small, because of the very small space requirement of the strip or strips 6. The useable payload (during launch by space launcher) is therefore optimised to the maximum;
- the mass per unit length of the strip 6 is very small, given the very small thickness thereof, combined with a width of a few centimeters only. The deployment device 5 with strip 6 is therefore extremely light;
- the number of mechanical parts is small;
- the manufacturing and integration cost is low;
- the deployment device 5 is very reliable. The reliability results from the small number of mechanical parts and the mechanism requiring precise adjustments;
- the kinematic connections do not comprise any particular adjustment, and are therefore fairly insensitive to differential thermal expansion; and
- the use of metal or composite materials makes it possible to guarantee an absence of degassing and resistance to conditions in space (radiation, atomic oxygen, etc.).

The reel device 7 is provided with an electric motor (not shown) arranged in the structure of the main panel 2, which rotates a reeling spindle 10 (depicted in FIG. 6), on which the strip 6 is reeled during rotation.

The segmented structure 1 also comprises a damping device 11 suitable for damping any shocks liable to be generated at least at the moment of locking of the strip 6 in the unwound position.

Figure 6:
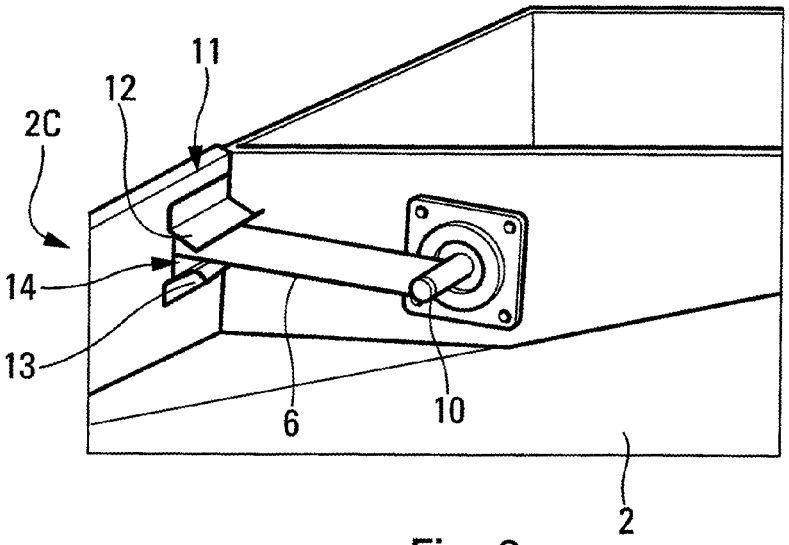
FIG. 6 shows schematically a reel device.

In a particular embodiment depicted in FIG. 6, this damping device 11 comprises two spring blades 12 and 13 mounted around the strip 6, at an opening 14 in the form of a slot, formed in the wall of the contact face 2C of the main panel 2. The strip 6 that passes through this opening 14 passes between the two leaf springs 12 and 13. These leaf springs 12 and 13 make it possible, through contact with the strip 6, to dampen the shock to the main panel 2 at the moment of locking of the strip 6, with decoupling of the strip guides with respect to the carrier structure.

Once the strip 6 is unwound in the straight position (FIG. 5D), with the deployable panel 3 attached at the end, the reel device 7, moved by the electric motor, brings (in the direction illustrated by an arrow E2 in FIGS. 5D and 5E) the secondary panel 3 towards the main panel 2.

If necessary, it is possible to provide synchronisation between the two (or even more than two) reel devices 7 of the deployment device 5, in particular by a flexible mechanical connection or by homokinetic constant velocity joints (of the tripod or Rzeppa type). It is also possible to envisage a single offset motor, intended for the various reel devices 7 of the deployment device 5.

The segmented structure 1 also comprises means configured so as to effect end guidance making it possible to achieve the deployed position P2. In a particular embodiment, these means comprise a normal cone/counter-cone system.

The deployment devices 5 of the segmented structure 1, associated with the various secondary panels 3 and 4 of this segmented structure 1, therefore make it possible to achieve deployment of the segmented structure 1 from a fully stowed position (in which all the secondary panels 3 and 4 are in a storage position P1, as depicted in FIG. 1) to a fully deployed position (in which all the secondary panels 3 and 4 are in a deployed position P2, as depicted in particular in FIG. 2).

The deployment device 5 also comprises means that are not shown (for example a central unit) for controlling in particular the electric motors of the reel devices 7 and/or generating a deployment instruction.

The functioning of the deployment device 5, for deploying one 3 of said secondary panels 3, 4, from the storage position P1 in FIG. 1 to the deployed position P2 in FIGS. 2 and 5F, is as follows:

a) the movement of the secondary panel 3 with respect to the main panel 2 is released, from the storage position P1 in FIG. 1 for example. This release allows automatic deployment of the prestressed strips 6, generating a movement of the secondary panel 3 towards the outside in the direction indicated by an arrow E1, as illustrated by various successive positions PA, PB and PC respectively in FIGS. 5A, 5B and 50. This makes it possible to bring the secondary panel 3 from the superimposed storage position P1 to a non-superimposed position PD (FIG. 5D) substantially in the same mid-plane as the main panel 2. Said strip 6 self-locks when it is fully unwound in the position PD in FIG. 5D; then b) the two strips 6 are reeled, by means of the associated reel devices 7, as illustrated by an intermediate position PE in FIG. 5E, so as to move the secondary panel 3 inwards in the direction illustrated by the arrow E2 and to move the secondary panel 3 towards the main panel 1 until their respective contact faces 2C and 3C are substantially in contact.

The deployment method also comprises an additional step consisting of effecting normal end guidance in order to achieve the deployed position P2, by bringing the secondary panel 3 in contact with the main panel 2 in the required final position, as illustrated in FIG. 5F.

To do this, the segmented structure 1 comprises means (not shown) for allowing a precise final positioning between the secondary panel 3 and the main panel 2, as well as means for locking the panel or panels in the deployed position P2.

The same deployment method is used for the secondary panel 4 so as finally to obtain a fully deployed position of the segmented structure 1, as depicted in FIG. 2.

Of course, the device 5 can also bring the segmented structure 1 from the deployed position P2 to the storage position P1, if this were to prove necessary, for example for a validation operation, by performing the aforementioned operations in the reverse order (b, a), with each operation performed in the reverse direction.

Figure 7:
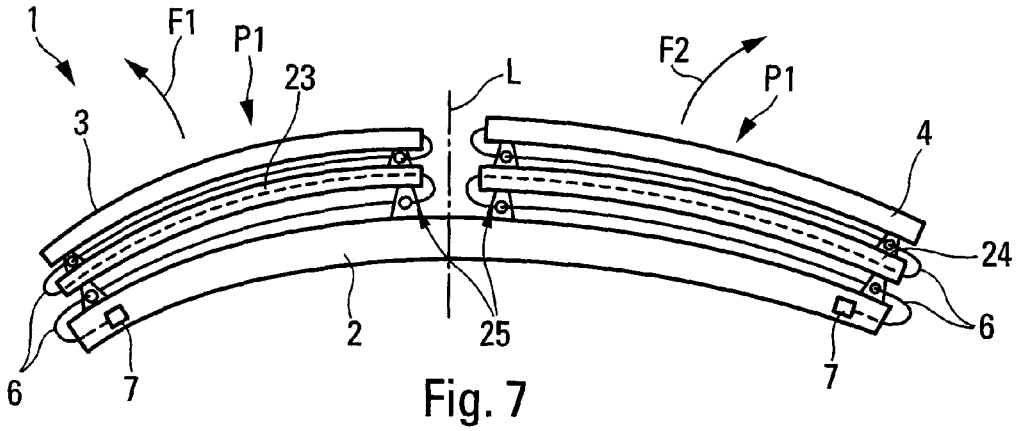
FIG. 7 illustrates schematically a particular embodiment of a segmented structure comprising a plurality of superimposed panels.

Moreover, in a particular embodiment, depicted schematically in FIG. 7, the segmented structure 1 comprises a plurality of panels (more than two panels) superimposed, thus making it possible to deploy large-sized systems in a plurality of directions.

In this case, the deployment device 5 is configured so as to effect the simultaneous deployment of the secondary panel 3, 4 and at least one intermediate panel 23, 24. This intermediate panel 23, 24 is arranged between the secondary panel 3, 4 and the main panel 2, superimposed in the storage position P1, as depicted in FIG. 7, and in lateral contact in the deployed position. In addition, the intermediate panel 23, 24 is connected to each strip 6 used so as to be able to slide along said strip 6.

In this case, in a particular embodiment, the strip 6 passes at least partly through the structure of the intermediate panel 23, 24, as depicted by the dashes in FIG. 7.

In the example in FIG. 7, the arrangement is symmetrical with respect to a transverse plane illustrated by a straight line L, and the deployment is performed:

for the assembly formed by the secondary panel 3 and the intermediate panel 23 in the direction illustrated by an arrow F1; and for the assembly formed by the secondary panel 4 and the intermediate panel 24 in the direction illustrated by an arrow F2.

In FIG. 7, normal stacking systems 25 have also been shown highly schematically.

The intermediate panels 23, 24 are floatingly mounted on the deployment strip or strips 6. In order to ensure absence of collision of the panels with each other and controlled and reproducible kinematics, the segmented structure 1 comprises a system 27 for blocking in translation the intermediate panels 23, 24 with respect to the strip or strips 6. This blocking system 27 is automatically retracted in a reliable manner during the operation of reeling the strips 6.

Figure 8A:
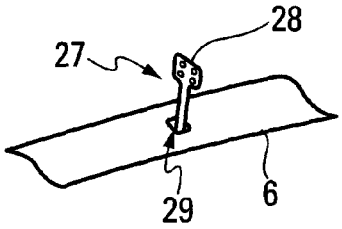
FIGS. 8A and 8B illustrate schematically an example of a blocking (or locking) element of a slide connection of an intermediate panel.
Figure 8B:
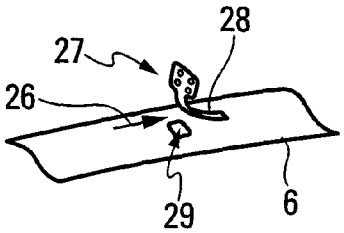

In a particular embodiment depicted in FIGS. 8A and 8B, the blocking system 27 comprises a flexible blade 28 (made from metal or composite material) that passes through the strip 6, through a small slot 29 formed in the strip 6. When a panel 23A is brought alongside an adjacent panel 23B, a finger 30 provided at the end of the panel 23A in the vicinity of the passage of the strip 6 folds this flexible blade 28 (as illustrated by an arrow 26 in FIG. 8B) until it is disengaged from the slot 29, thus releasing the slide connection.

Figure 9A:
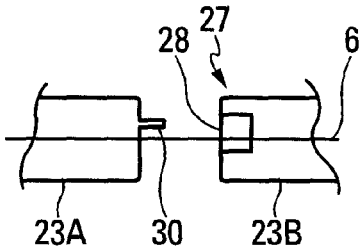
FIG. 9A to 9C show various steps of unlocking of a locked slide connection.
Figure 9B:
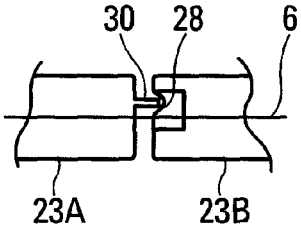
Figure 9C:
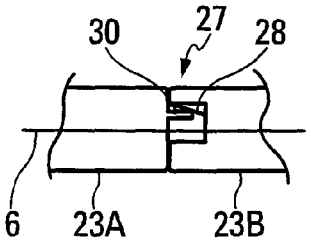

FIG. 9A to 9C illustrate various steps of such a release at two adjacent panels 23A and 23B (corresponding to the main panel and an adjacent intermediate panel, or to two adjacent intermediate panels, or to the secondary panel and to an adjacent intermediate panel). More precisely:

in FIG. 9A, the connection is locked and the flexible blade 28 passes through the strip 6;

in FIG. 9B, the connection is still locked, but the panel 23A approaches the panel 29B and the blade 28 folds under the force of the finger 30 and begins to disengage; and in FIG. 90, the intermediate panel 23A is guided to the end of the intermediate panel 23B, the blade 28 is disengaged from the strip 6 and the connection is therefore unlocked.

Moreover, in order to activate the stacking systems 25 offset on the intermediate panels, the strips 6 may be used to directly conduct the necessary electrical energy without the addition of dedicated cabling, which has advantages in terms of simplicity and robustness.

Figure 10:
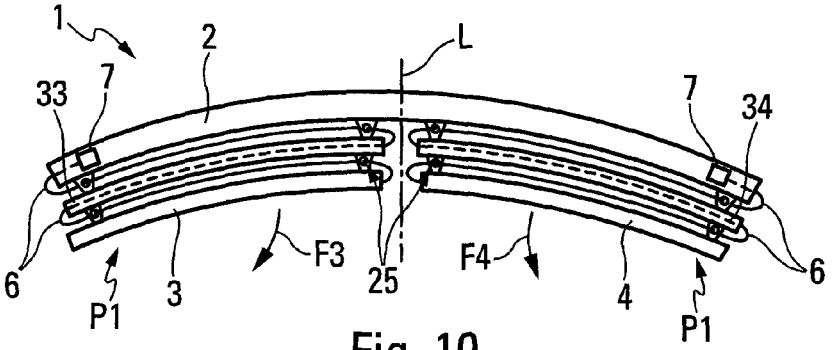
FIG. 10 illustrates schematically a particular embodiment of a segmented structure, comprising a plurality of superimposed panels within a parabola.

In a variant depicted in FIG. 10, unlike the example in FIG. 7, the segmented structure 1 is such that the panels (secondary panel 3 and intermediate panel or panels 33 on one side; secondary panel 4 and intermediate panel or panels 34 on the other side) are superimposed within the parabola. In other words, the face (referred to as the rear face) of the main panel 2 (on which the (so-called front) face of another panel is superimposed in the storage position) is situated within the parabola (rather than outside as in the example in FIG. 7) and corresponds to a reflective face in the case of a parabolic reflector.

In this case, the left-hand panels (with respect to the plane L) are released before or after the right-hand panels in order not to cause a collision.

In the example in FIG. 10, the deployment is performed:

for the assembly formed by the secondary panel 3 and the intermediate panel 33 in the direction illustrated by an arrow F3; and for the assembly formed by the secondary panel 4 and the intermediate panel 34 in the direction illustrated by an arrow F4.

The segmented structure 1 as described above, comprising in particular a deployment device 5, makes it possible to achieve a deployment that is simple and reliable by design, very light, and very compact in terms of payload, and has a low production and integration cost. In addition, it is possible to deploy a plurality of superimposed panels in order to deploy large systems 1 in a plurality of directions.

The invention claimed is:

1. A segmented structure, in particular for a satellite antenna reflector, said segmented structure comprising:

at least two panels, a first so-called main panel comprising a front face and a rear face, and a second so-called secondary panel also comprising a front face and a rear face; and at least one deployment device connected to the rear faces respectively of said main and secondary panels and configured to bring said secondary panel into one or other of the following two positions, relative to said main panel:

a storage position, in which said secondary panel is at least partly superimposed on said main panel on the rear face thereof, the front face of said secondary panel being directed in the same direction as the front face of said main panel; and a deployed position, in which said secondary panel is positioned towards the outside of the main panel, alongside and against said main panel so as to form a continuous assembly at least on their front faces, wherein said deployment device comprises:

at least one strip, said strip being fixed by a first of its ends to the secondary panel at a so-called contact face thereof, which comes into contact with a so-called contact face of the main panel in the deployed position, and being connected to the main panel at the contact face thereof, said strip:

having a flexibility allowing the strip to be folded at least at so-called hinge regions in the storage position;

being resiliently prestressed in the storage position so as to unwind automatically and autonomously, when the movement between the secondary panel and the main panel is released, so as to move the secondary panel during the unwinding until the strip reaches a substantially rectilinear unwound position, and self-locking in the unwound position, and at least one reel device that is configured to reel up said strip from its unwound position, a reeling of the strip bringing the secondary panel towards the main panel.

2. A segmented structure according to claim 1, further comprising removable means for holding the secondary panel on the main panel, said holding means being controllable to release the secondary panel from the main panel when the main panel and secondary panel are controlled, such release allowing the movement between said secondary panel and said main panel.

3. A segmented structure according to claim 1, wherein said strip has at least one of the following features:

the strip is provided with flexible thermal shields at least at said hinge regions;

the strip is provided, at least partly, with a surface treatment; and the strip is made of one of a metal material and a composite material.

4. A structure according to claim 1, further comprising removable auxiliary holding means suitable for holding the strip in the storage position.

5. A structure according to claim 1, further comprising means for generating thrust on the secondary panel to move the secondary panel away from the main panel so as to assist the deployment.

6. A structure according to claim 1, wherein said reel device is provided with an electric motor arranged in the structure of the main panel.

7. A structure according to claim 1, further comprising a damping device suitable for damping any shock liable to be generated at least at the moment of the self-locking of said strip.

8. A structure according to claim 1, further comprising means configured so as to effect end guidance making it possible to achieve the deployed position.

9. A structure according to claim 1, wherein said deployment device is configured so as to effect a simultaneous deployment of the secondary panel and of at least one intermediate panel that are such that said intermediate panel is arranged between the secondary panel and the main panel, superimposed in the storage position and in lateral contact in the deployed position, and in that said intermediate panel is connected to said strip so as to slide along said strip.

10. A segmented structure according to claim 9, wherein said strip passes at least partly through the structure of said intermediate panel.

11. A segmented structure according to claim 1, comprising:

a middle main panel;

two secondary panels arranged on either side of said middle main panel in the deployed position so as to have a parabolic shape; and two deployment devices associated respectively with said secondary panels.

12. A satellite antenna reflector comprising a segmented structure according to claim 1.

13. A satellite comprising at least one segmented structure according to claim 1.

14. A method for deploying a segmented structure according to claim 1, comprising successive steps of, during the deployment from the storage position to the deployed position:

(a) releasing the movement of the secondary panel with respect to the main panel, this release allowing automatic unwinding of the prestressed strip so as to bring the secondary panel from a superimposed position to a position substantially in the same mid-plane as the main panel, said strip self-locking when the strip is completely unwound; and (b) reeling up the strip, by means of the reel device, so as to bring the secondary panel towards the main panel until their respective contact faces are substantially in contact.

15. A deployment method according to claim 14, comprising a supplementary step of effecting end guidance for achieving the deployed position.

* * * * *